US008348677B2

(12) United States Patent
Angerpointner et al.

(10) Patent No.: US 8,348,677 B2
(45) Date of Patent: Jan. 8, 2013

(54) SLIP-RING UNIT

(75) Inventors: Ludwig Angerpointner, Munich (DE); Norbert Friese, Taufkirchen (DE)

(73) Assignees: LTN Servotechnik GmbH, Otterfing (DE); MD Elektronik GmbH, Waldkraiburg (DE)

( * ) Notice: Subject to any disclaimer, the term of this patent is extended or adjusted under 35 U.S.C. 154(b) by 69 days.

(21) Appl. No.: 13/124,326

(22) PCT Filed: Sep. 10, 2009

(86) PCT No.: PCT/EP2009/006564

§ 371 (c)(1),
(2), (4) Date: Jul. 11, 2011

(87) PCT Pub. No.: WO2010/043290

PCT Pub. Date: Apr. 22, 2010

(65) Prior Publication Data

US 2012/0129360 A1 May 24, 2012

(30) Foreign Application Priority Data

Oct. 15, 2008 (DE) ..... 10 2008 051 671

(51) Int. Cl.
*H01R 39/00* (2006.01)

(52) U.S. Cl. ..... 439/23

(58) Field of Classification Search ..... 439/13, 439/18, 22–27; 310/232
See application file for complete search history.

(56) References Cited

U.S. PATENT DOCUMENTS

| | | | | | |
|---|---|---|---|---|---|
| 3,988,049 | A | * | 10/1976 | Williams et al. | 439/23 |
| 4,105,907 | A | * | 8/1978 | Hagenlocher et al. | 310/232 |
| 4,347,453 | A | * | 8/1982 | Gaus | 310/104 |
| 4,870,311 | A | * | 9/1989 | Chase et al. | 310/232 |
| 5,139,281 | A | * | 8/1992 | Dzioba | 280/775 |
| 5,866,967 | A | * | 2/1999 | Sasaki | 310/232 |
| 5,952,762 | A | * | 9/1999 | Larsen et al. | 310/232 |
| 7,621,867 | B2 | * | 11/2009 | Kura et al. | 600/137 |
| 7,719,158 | B2 | | 5/2010 | Angerpointner et al. | |

FOREIGN PATENT DOCUMENTS

| | | |
|---|---|---|
| DE | 103 06 330 | 9/2004 |
| EP | 1 808 941 | 7/2007 |

OTHER PUBLICATIONS

International Search Report, issued in corresponding International Application No. PCT/EP2009/006564.

* cited by examiner

*Primary Examiner* — Tho D Ta
*Assistant Examiner* — Larisa Tsukerman
(74) *Attorney, Agent, or Firm* — Kenyon & Kenyon LLP

(57) ABSTRACT

In a slip-ring unit for electrically connecting two components that are rotatable relative to each other, one component is arranged as a first cable, which has a core and a shield. The slip-ring unit includes first, second and third brush elements as well as first, second and third slip bodies. The first slip body has an opening extending through it axially, through which a first cable extends for transmitting the voltage applied on the core. The second brush element is additionally disposed at a radial offset with respect to the third brush element.

17 Claims, 4 Drawing Sheets

SLIP-RING UNIT

FIELD OF THE INVENTION

The present invention relates to a slip-ring unit for electrically connecting two components that are rotatable relative to each other.

BACKGROUND INFORMATION

Slip-ring units are frequently made up, inter alia, of a slip-ring brush and slip bodies, in particular slip rings, the slip-ring brush having sliding contact with rotating slip rings during operation. Such slip-ring units are used in many technical fields for transmitting electrical voltages, in particular signals or electrical power, for example, from a stationary electrical unit to a rotating electrical unit. For this purpose it is important that a sound and continuous contact is provided between the slip-ring brush and the slip rings, for example via spring-loaded brush elements.

For rotatably connecting electronic cameras, for example, it may be necessary that both high-frequency digital image signals as well as analog currents, such as the current supply of the camera, are reliably transmittable. In medical technology for surgical applications, for example, there is the desire to be able to operate such rotatable cameras reliably.

European Patent No 1 808 941 shows a slip-ring unit, in which bent brush wires transmit electrical voltages or currents or signals to rotatable slip rings. Such systems are not suitable, however, for reliably transmitting high-frequency digital signals, which are normally transmitted in shielded lines, in addition to the analog currents from the brush wires to a slip ring rotating relative to the brush wires.

SUMMARY

Example embodiments of the present invention provide a compact slip-ring unit for reliably and securely transmitting electrical voltages, in particular analog currents and digital signals, which is manufacturable with little expenditure.

Accordingly, the slip-ring unit of example embodiments of the present invention is configured so as to be suitable for electrically connecting two components that are rotatable relative to each other. One of the components is arranged as a first cable, which has a core and a shield. The slip-ring unit includes a first brush element, which is in electrical contact with a first slip body. Furthermore, the slip-ring unit includes a second brush element, which is in electrical contact with a second slip body, for transmitting a voltage applied on the core. Finally, the slip-ring unit includes a third brush element, which is in electrical contact with a third slip body for transmitting a voltage or electrical potential applied on the shield. The first slip body has an opening extending through it axially, through which the first cable is run for transmitting the voltage applied on the core. The second brush element is disposed at a radial offset with respect to the third brush element.

The respective brush element is able to apply a contact pressure on the respective slip body, which has a radial directional component. In addition to the radial offset with respect to the third brush element, the second brush element may also be disposed in overlapping fashion with respect to the third brush element in the axial direction. That is to say that both the second brush element as well as the third brush element are disposed in one (one and the same) cross section of the slip-ring unit. The cross section of the slip-ring unit is a section through the slip-ring unit, which is oriented orthogonally with respect to the axis of rotation.

A transmission of electrical voltages fundamentally also involves a transmission of electrical currents, unless there is an infinitely high electrical resistance. Therefore, in the following, a transmission of voltage may normally be understood also as a transmission of current. Furthermore, electrical signals are physically also based on electrical voltages such that the transmission of voltages can also signify a transmission of signals. Since electrical voltages are often referred to as electrical potentials, the slip-ring unit is also able to transmit shielded potentials in particular.

The first brush element, which is in electrical contact with a first slip body, may be arranged, for example, for transmitting analog currents for supplying power to an electrical device.

The second brush element, which is in electrical contact with the second slip body, may be used to transmit a signal applied on the core, in particular a digital high-frequency signal.

The type of construction described herein provides a particularly advantageous assemblage such that a slip-ring unit that is compact and simple to manufacture makes it possible to transmit a various types of electrical voltages, in particular currents and digital signals, in a rotatable manner, an effective shielding being ensured for the transmission of the signals. Accordingly, the shielded potential is also transmitted over shielded lines that are rotatable relative to each other.

The slip-ring unit advantageously includes multiple first brush elements and multiple first slip bodies for transmitting electrical voltages, in particular analog currents, the first brush elements and the first slip bodies being respectively disposed at an axial offset with respect to one another.

A type of construction is advantageous, in which the first slip body has a central bore extending through it axially for accommodating the first cable. In this case, the slip body may be arranged in a ring-shaped manner and may consequently be referred to as a slip ring.

The second brush element may be disposed axially offset with respect to the first brush element.

Advantageously, the first cable is disposed so as to be rotatable relative to the first brush element. Accordingly, the first cable may be disposed in the slip-ring unit so as to be non-rotatable relative to the first slip body. For example, in the operation of the slip-ring unit, the first cable may rotate along with the first slip body.

The slip-ring unit may transmit electrical voltages from the first cable to a second cable, the second cable having a core and a shield, the shield of the second cable being electrically connected to a sleeve and the shield of the first cable being electrically connected to the third slip body, and the sleeve as well as the third slip body being disposed so as to overlap in the axial and in particular also in the radial direction. The first cable and the second cable may be arranged as coaxial cables.

Frequently, the voltages to be transmitted, in particular digital signals, have a comparatively high frequency, often greater than 250 MHz, or greater than 1 GHz. Hence it is important, with a view to the transmission of the digital signals, that the slip-ring unit emits no electromagnetic interference pulses and is also protected particularly against influences of external electromagnetic fields. A high degree of reliability in this regard is required particularly in medical technology applications.

Advantageously, the slip-ring unit allows for the transmission of electrical voltages, in particular analog currents, from a third cable to a fourth cable, it being possible for the third cable to be run through the opening extending axially through the first slip body.

In an advantageous type of construction, the slip-ring unit is configured such that the slip-ring unit allows for the transmission of electrical voltages, in particular analog currents, from a third cable to a fourth cable and for the transmission of electrical voltages, in particular digital signals, from the first cable to a second cable, the fourth cable extending within a housing of the slip-ring unit in an offset manner radially outside of the second cable.

Either the second brush element or the third brush element or both brush elements may be arranged as a hollow body. For this purpose, one of the brush elements or both brush elements may be configured such that the respective brush element or the brush elements have radially springy properties. In particular, the second brush element or the third brush element or both may have radially spring-loaded tabs. Alternatively, the second brush element or the third brush element or both brush elements may also be arranged as flat spiral springs having a cycloid-like geometry so as to allow for a comparatively soft slip contact.

The core of the first cable is advantageously electrically connected to the electrically conductive second slip body and a molding compound is provided, which encloses the second slip body and the core for absorbing at least a portion of the torque required for operating the slip-ring unit.

Furthermore, for absorbing at least a portion of the torque required for operating the slip-ring unit, the slip-ring unit may be arranged such that electrical voltages, in particular digital signals, are transmittable from the first cable to a second cable and that the second cable has a core and a shield, the core of the second cable being electrically connected to an electrically conductive element. For this purpose, a molding compound is provided, which encloses the element and the core. The element may act as a support for the second brush element such that when the slip-ring unit is in operation, a torque, resulting from tangential forces of friction, is introduced into the slip-ring unit via the element.

The molding compound may be understood for example as a substance that is initially free-flowing and then hardenable, that is, including an adhesive. The molding compound may be surrounded by a sleeve. Additionally, an improvement of the torque transmission may be achieved if a) the slip body or b) the specified element respectively has at least one recess for a force-locking connection of the molding compound with the slip body or the element.

Further details and advantages of the slip-ring unit according to example embodiments of the present invention are described in more detail below with reference to the attached Figures.

DETAILED DESCRIPTION

The slip-ring unit of the exemplary embodiment is used to transmit electrical voltages, in the present case analog currents and digital signals in particular, such that for example a rotatable electronic camera may be connected to a stationary unit. The analog currents are for example currents for moving actuating motors, e.g. of a zoom drive, and currents for operating the electronics of the camera. For the transmission of images, the camera supplies high-frequency digital signals, which may likewise be transmitted by the slip-ring unit in an interference-free manner.

Figure 1:
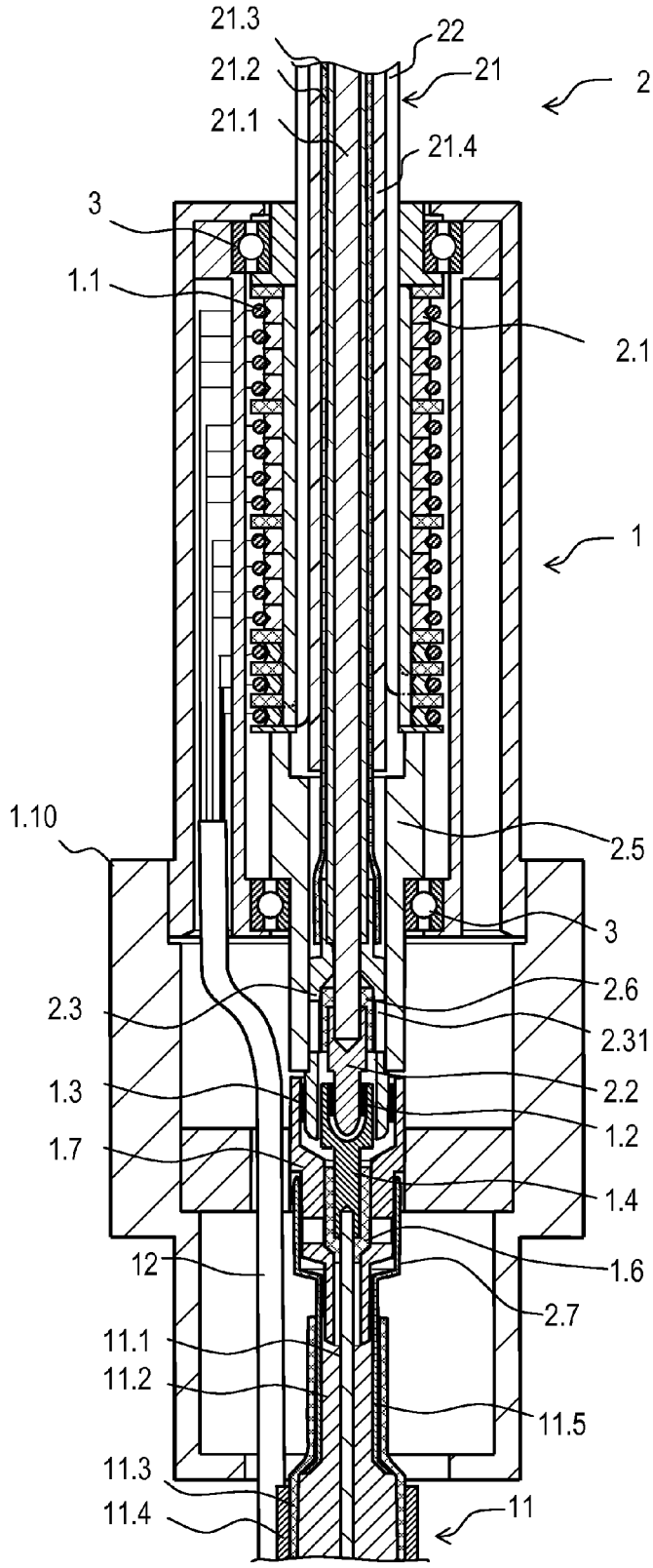
FIG. 1 is a sectional view of a slip-ring unit.
Figure 3:
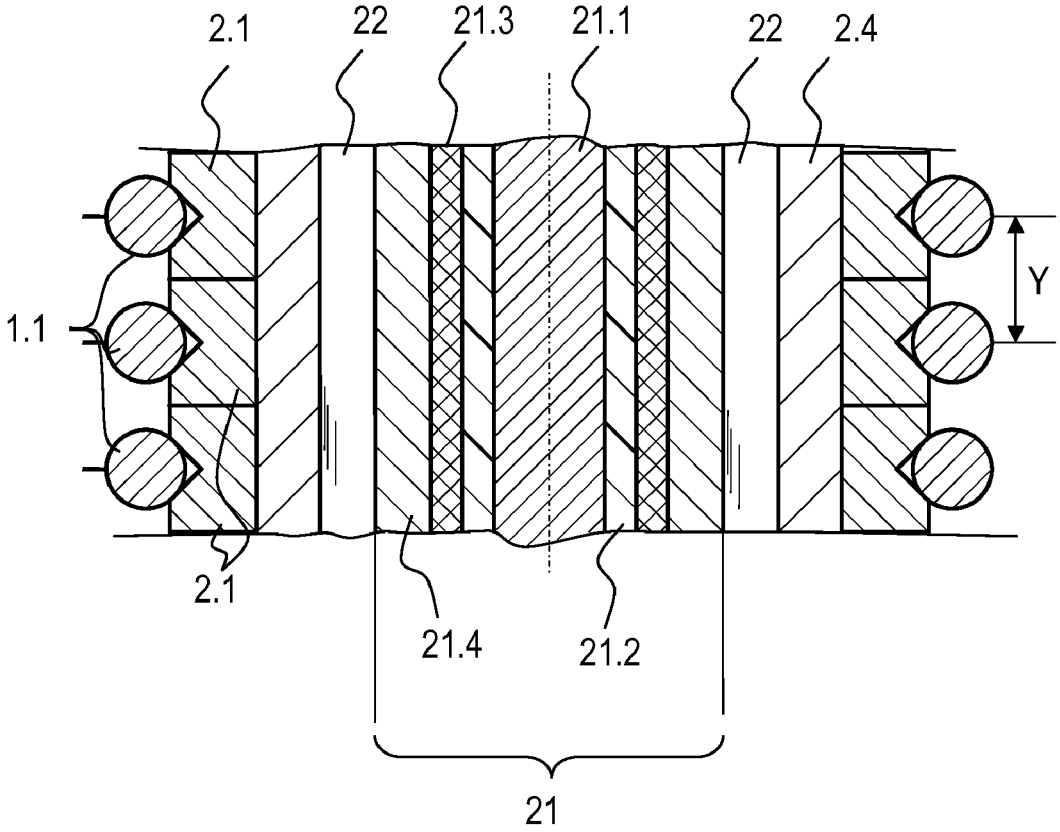
FIG. 3 is an enlarged view of the sectional view of the slip-ring unit, in particular the area for transmitting analog currents.

As shown in FIG. 1, the slip-ring unit has a stator 1 and a rotor 2. Rotor 2 is disposed in a rotatable manner relative to stator 1 with the aid of bearings 3. Among other things, a first cable 21, which is arranged as a so-called coaxial cable, extends in rotor 2, concentrically to the axis of rotation (see also FIG. 3). First cable 21 is used to transmit the digital signals, which have a frequency in the GHz range. It has a central electrically conductive core 21.1, which is surrounded by a dielectric layer 21.2. Dielectric layer 21.2 in turn is surrounded by a shield 21.3, shield 21.3 including a metal braid in the illustrated exemplary embodiment. First cable 21 furthermore has an outer insulation 21.4.

As shown in FIG. 1, shield 21.3 of first cable 21 is electrically connected, e.g. by a crimp connection, to a sleeve 2.3, which acts as a (third) slip body. Furthermore, core 21.1 of first cable 21 is electrically contacted and mechanically fastened in a rotationally fixed manner to a pin 2.2, in this case by a soldered connection. Pin 2.2 has a central axial blind-end bore, into which core 21.1 is inserted. As will be explained below, pin 2.2 acts in the slip-ring unit as a (second) slip body. So that the soldered connection may be produced in the course of assembling the slip-ring unit, a radially oriented bore 2.31 is worked into sleeve 2.3 such that access is ensured to the designated soldering point. In order to reinforce the mechanical connection between core 21.1 and pin 2.2 acting as a slip body, a molding compound 2.6 is introduced through bore 2.31 after soldering, which contributes toward absorbing the torque arising in the operation of the slip-ring unit. For this purpose, a radial recess is additionally provided on pin 2.2, which is not shown in the Figures, but which is fundamentally arranged like groove 1.41 described further below. Molding compound 2.6 is surrounded by sleeve 2.3 such that the radial space between sleeve 2.3 and pin 2.2 or between sleeve 2.3 and core 21.1 is filled in an axial section with molding compound 2.6. Thus both sleeve 2.3 as well as pin 2.2 and core 21.1 are surrounded by molding compound 2.6.

Sleeve 2.3 is surrounded by a component 2.5 of rotor 2, which is supported on one of the bearings 3.

First cable 21 is surrounded radially by a third cable 22, which is made up of multiple insulated individual strands. The individual strands of third cable 22 respectively extend radially outward through a slot in an electrically insulating support sleeve 2.4 of rotor 2 to respectively one first slip body, in this case respectively one slip ring 2.1. On the radial inner side of slip rings 2.1, the individual strands of third cable 22 are respectively contacted. Slip rings 2.1 are mounted at an axial offset Y axially side-by-side on insulating carrier sleeve 2.4, an electrically non-conductive insulating ring being possibly disposed between adjacent slip rings 2.1. In the exemplary embodiment shown, all slip rings 2.1 are disposed coaxially. Each slip ring 2.1 has a circumferential groove, which has a V-shaped geometry (see also FIG. 3).

Furthermore, a second cable 11 is disposed coaxially in housing 1.10 of stator 1, alongside which a fourth cable 12 extends substantially in axially parallel fashion.

Second cable 11 is used to transmit the digital signals and is likewise arranged as a coaxial cable, that is, in principle constructed like first cable 21, such that it has a core 11.1, a dielectric 11.2, a sleeve 11.3 and an insulating outer layer 11.4. Shield 11.3 is electrically connected to a hollow body 2.7, for example by a crimp connection. Another sleeve is fastened to hollow body 2.7 in axial extension, which in the following is called support sleeve 1.7.

Figure 2:
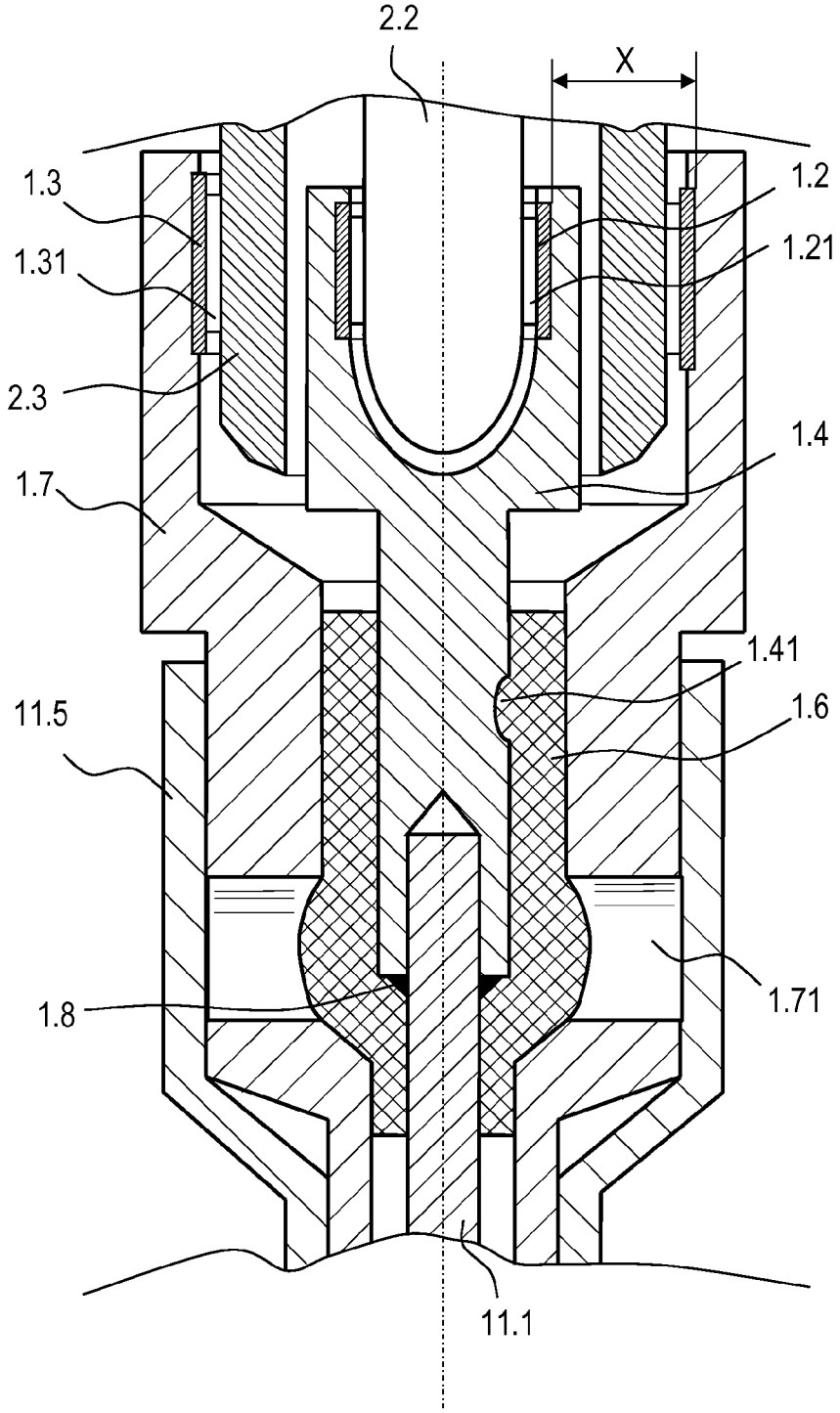
FIG. 2 is an enlarged view of the sectional view of the slip-ring unit, in particular the area for transmitting digital signals.

As shown in detail in FIG. 2, core 11.1 of second cable 11 is connected electrically and in a mechanically rotationally fixed manner to a sleeve-shaped element 1.4 by a soldered connection 1.8. Sleeve-shaped element 1.4 has a recess in the form of a groove 1.41. Alternatively, multiple recesses may also be worked into element 1.4. The soldering is performed through a radial bore 1.71 in support sleeve 1.7. Following the soldering process, molding compound 1.6 is pressed through bore 1.71 into the hollow space between support sleeve 1.7 and element 1.4 or between support sleeve 1.7 and core 11.1. Molding compound 1.6 subsequently hardens and acts to absorb at least a portion of the torque required for operating the slip-ring unit. The load-bearing capacity of this connection is reinforced by recess 1.41, by which a force-locking connection between molding compound 1.6 and sleeve-shaped element 1.4 is established. In addition, a force-locking connection is also achieved between molding compound 1.6 and support sleeve 1.7. For the volume of molding compound 1.6 is distributed in such a way that molding compound 1.6 also remains in bore 1.71 such that it there extends radially beyond the inner diameter of support sleeve 1.7, thus producing a form-lock there as well.

Otherwise, the rotor-side connection between molding compound 2.6 and sleeve 2.3 is arranged analogous to the described connection to stator-side molding compound 1.6.

Fourth cable 12 is used to transmit the analog currents and also has multiple individual strands. Within housing 1.10, the individual strands are brought into contact with first brush elements 1.1. In the example shown, first brush elements 1.1 are fastened to a support, which is arranged as a circuit board and is otherwise not shown in the Figures. First brush elements 1.1 are moreover arranged in this case as spring-loaded wire brackets, which are disposed at an axial offset Y with respect to one another.

Figure 4A:
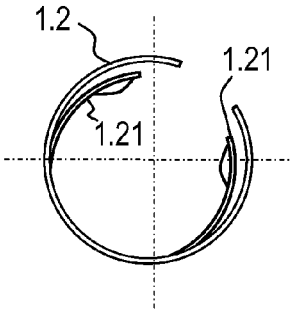
FIG. 4*a* is a lateral view of a brush element for transmitting digital signals.
Figure 4B:
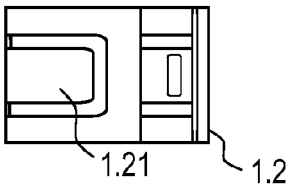
FIG. 4*b* is a top view of the brush element for transmitting digital signals.

A spring-loaded sheet metal is used as the second brush element 1.2, which is disposed between pin 2.2 as the second slip body and sleeve-shaped element 1.4. FIGS. 4*a* and 4*b* show second brush element 1.2. Second brush element 1.2 is made from a thin (0.1 mm) strip of sheet metal, which is bent to form an open ring and into which recesses or openings are worked by an etching process so as to produce tabs 1.21. These tabs 1.21 are bent radially inward in order to achieve the spring effect. Each tab 1.21 additionally includes a protrusion directed radially inward and produced by a bending process, which is used to establish a slip contact on the surface of pin 2.2. Second brush element 1.2 may be introduced axially into element 1.4, a recess in element 1.4 securing second brush element 1.2 axially relative to sleeve-shaped element 1.4.

Figure 5A:
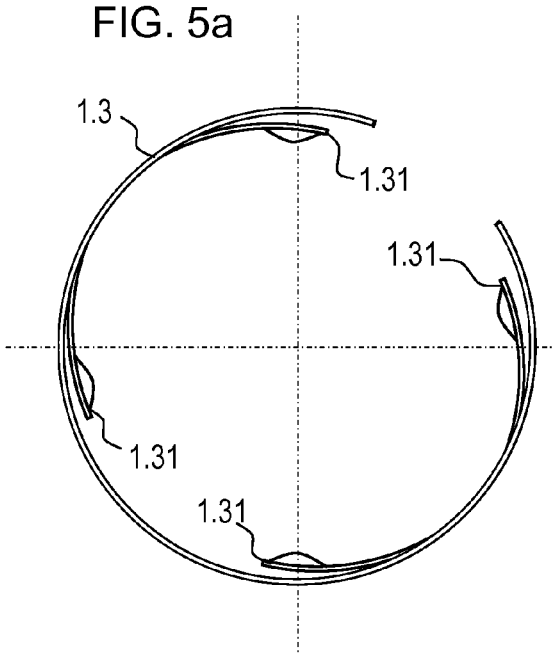
FIG. 5*a* is a lateral view of another brush element for transmitting the electrical potential of a shield.
Figure 5B:
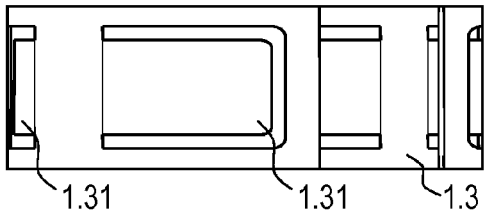
FIG. 5*b* is a top view of the other brush element for transmitting the electrical potential of the shield.

As shown in FIGS. 5*a* and 5*b*, third brush element 1.3, which likewise includes spring-loaded tabs 1.31, is constructed analogously. Third brush element 1.3 is fastened in support sleeve 1.7 according to the same principle as second brush element 1.2 in sleeve-shaped element 1.4. For reasons of clarity, FIG. 5*b* does not show the contours normally visible through the slots in brush element 1.3.

After second brush element 1.2 and third brush element 1.3 have been fastened in this manner, pin 2.2 and sleeve 2.3 may be slid into brush elements 1.2 or 1.3. Subsequently, stator-side support sleeve 1.7 and rotor-side sleeve 2.3 are disposed so as to overlap in the axial direction, which is significant in particular for shielding against electromagnetic radiation since support sleeve 1.7 and sleeve 2.3 are in electrical contact with shields 11.3, 21.3.

When the slip-ring unit is in operation, the axis of rotation of rotor 2 is at the same time the rotational axis of the slip-ring unit such that rotor 2 is rotatable about the rotational axis relative to all brush elements 1.1, 1.2, 1.3. The new construction creates an exceedingly compact and reliable slip-ring unit. In particular, the slip-ring unit is able to transmit both digital signals between the first and second cables 21, 11, which are rotatable relative to each other, as well as analog currents between the third and fourth cables 12, 22, which are rotatable relative to each other. The type of construction is especially distinguished by the fact that first cable 21 extends through the hollow space formed by the slip rings 2.1 axially disposed side-by-side. Moreover, second brush element 1.2 is disposed at a radial offset X (see FIG. 2) with respect to third brush element 1.3. This construction allows for an exceedingly reliable electrical transmission, which allows for an operation that is unsusceptible to electromagnetic interferences in spite of having respectively slipping contacts.

In order to absorb radial compensation movements, support sleeve 1.7 and/or sleeve-shaped element 1.4 may be disposed in the slip-ring unit in a radially floating manner.

Incidentally, one of the bearings 3, in particular the bearing 3 situated further inside housing 1.10, may be eliminated. In such a construction in particular, a machine element, for example a Seeger ring, may then be provided for axially securing rotor 2 with respect to the stator. Furthermore, in this constructional modification of the slip-ring unit, the second and the third brush elements may be arranged such that they absorb radial forces in the sense of a bearing.

Of course, the manner of functioning of the slip-ring unit may also be reversed such that stator 1 rotates in operation, while rotor 2 is stationary.

What is claimed is:

1. A slip-ring unit, for electrically connecting two components that are rotatable relative to each other, one component arranged as a first cable having a core and a shield, comprising:

a first brush element in electrical contact with a first slip body;

a second brush element in electrical contact with a second slip body and adapted to transmit a voltage applied to the core;

a third brush element in electrical contact with a third slip body and adapted to transmit a voltage applied to the shield;

wherein the first slip body includes an opening extending axially therethrough, the first cable adapted to transmit the voltage applied to the core and extending through the opening, the second brush element arranged at a radial offset with respect to the third brush element.

2. The slip-ring unit according to claim 1, wherein the slip-ring unit includes a plurality of first brush elements and a plurality of first slip bodies adapted to transmit voltages, the first brush elements respectively disposed at an axial offset with respect to one another.

3. The slip-ring unit according to claim 1, wherein the first slip body includes a central bore extending axially therethrough and arranged to accommodate the first cable.

4. The slip-ring unit according to claim 1, wherein the second brush element is disposed in an axially offset manner with respect to the first brush element.

5. The slip-ring unit according to claim 1, wherein the first cable is rotatable relative to the first brush element.

6. The slip-ring unit according to claim 1, wherein the slip-ring unit is adapted to transmit electrical voltages from the first cable to a second cable, the second cable including a core and a shield, the shield of the second cable electrically connected to a sleeve, the shield of the first cable electrically connected to the third slip body, the sleeve and the third slip body arranged in an overlapping manner in the axial direction.

7. The slip-ring unit according to claim 1, wherein the slip-ring unit is adapted to transmit electrical voltages from a third cable to a fourth cable, the third cable extending through the opening of the first slip body extending axially therethrough.

8. The slip-ring unit according to claim 1, wherein the slip-ring unit is adapted to transmit electrical voltages from a third cable to a fourth cable and to transmit electrical voltages from the first cable to a second cable, the fourth cable extending within a housing of the slip-ring unit offset radially outside of the second cable.

9. The slip-ring unit according to claim 1, wherein at least one of (a) the second brush element and (b) the third brush element is arranged as a hollow body and is radially springy.

10. The slip-ring unit according to claim 1, wherein at least one of (a) the second brush element and (b) the third brush element includes radially spring-loaded tabs.

11. The slip-ring unit according to claim 1, wherein the core of the first cable is electrically connected to the second slip body, a molding compound surrounding the second slip body and the core, the molding compound adapted to absorb at least a portion of torque required to operate the slip-ring unit.

12. The slip-ring unit according to claim 11, wherein the molding compound is surrounded by at least one of (a) a sleeve and (b) the third slip body.

13. The slip-ring unit according to claim 11, wherein the third slip body includes a recess adapted to connect the molding compound and the third slip body in a force-locking manner.

14. The slip-ring unit according to claim 1, wherein the slip-ring unit is adapted to transmit electrical voltages from the first cable to a second cable, the second cable including a core and a shield, the core of the second cable electrically connected to an element, a molding compound surrounding the element and the core, the molding compound adapted to absorb at least a portion of torque required to operate the slip-ring unit.

15. The slip-ring unit according to claim 14, wherein the molding compound is surrounded by at least one of (a) a sleeve and (b) the third slip body.

16. The slip-ring unit according to claim 14, wherein the third slip body includes a recess adapted to connect the molding compound and the third slip body in a force-locking manner.

17. The slip-ring unit according to claim 14, wherein the element includes a recess adapted to connect the molding compound and the element in a force-locking manner.

* * * * *